US006346712B1

(12) United States Patent
Popovic et al.

(10) Patent No.: US 6,346,712 B1
(45) Date of Patent: Feb. 12, 2002

(54) FLAME DETECTOR

(75) Inventors: Radivoje Popovic, Zug; Alexandre Pauchard, Bulle, both of (CH); Adrian Flanagan, Espoo (FI); Robert Racz, Zug (CH); Dragan Manic, Lausanne (CH); Reinoud Felix Wolffenbuttel, Delft (NL)

(73) Assignee: Electrowatt Technology Innovation AG, Zug (CH)

( * ) Notice: Subject to any disclaimer, the term of this patent is extended or adjusted under 35 U.S.C. 154(b) by 0 days.

(21) Appl. No.: 09/292,630

(22) Filed: Apr. 15, 1999

(30) Foreign Application Priority Data

Apr. 24, 1998 (EP) ..... 98107659

(51) Int. Cl.[7] ..... G01J 5/00; G01J 5/02

(52) U.S. Cl. ..... 250/554; 250/214 R; 250/338.1; 250/339.15

(58) Field of Search ..... 250/554, 214 R, 250/338.1, 339.15; 340/577, 578

(56) References Cited

U.S. PATENT DOCUMENTS 3,940,753 A * 2/1976 Muller ..... 340/227 R
4,157,506 A 6/1979 Spencer
4,878,831 A * 11/1989 Ewing ..... 250/339.15
5,071,106 A * 12/1991 Helkenberg ..... 266/58
5,339,070 A * 8/1994 Yalowitz et al. ..... 250/339.01
5,434,560 A * 7/1995 King et al. ..... 340/578

FOREIGN PATENT DOCUMENTS

| | | |
|---|---|---|
| DE | 1 248 214 | 8/1967 |
| DE | 23 44 934 | 3/1975 |
| GB | 2 107 050 A | 4/1983 |
| JP | 61 280313 A | 10/1986 |

* cited by examiner

*Primary Examiner*—F. L. Evans
*Assistant Examiner*—Zandra V. Smith
(74) *Attorney, Agent, or Firm*—Proskauer Rose LLP

(57) ABSTRACT

A flame detector with a radiation sensor (1) sensitive in the ultra-violet and/or visible range of the electro-magnetic spectrum, forms from the signal U1 at the output of the radiation sensor, a first signal U2 which is proportional to the direct voltage portion of the signal U1, and a second signal U3 which is proportional to the alternating voltage portion of the signal U1. The output signal UA of the flame detector is formed such that UA=U2−U3. Ignition sparks can thereby be effectively suppressed.

5 Claims, 2 Drawing Sheets

FLAME DETECTOR

BACKGROUND OF THE INVENTION

1. Field of the Invention

The invention relates to a flame detector.

2. Description of the Prior Art

A known flame detector has a radiation sensor sensitive in the ultra-violet and/or visible range of the electro-magnetic spectrum. Such flame detectors are used for the monitoring of the flame in furnaces. Their task is to recognise when the flame is extinguished, without delay if possible. Flame detectors are a key element in the safety concept of the furnace. In order to obtain a high degree of reliability for the flame detector and for the furnace, it is necessary for the flame detector to respond only to the radiation of the flame, and not to be sensitive to parasitic effects. One source of parasitic effects is sparks occurring when the flame is ignited.

Known solutions for avoiding the unwanted detection of ignition sparks are, on the one hand, optical shielding which prevents the radiation of the ignition sparks from reaching the flame detector. On the other hand, flame detectors are used which are sensitive in the infra-red range of the electro-magnetic spectrum, as the portion of radiation of the ignition sparks in this range is insignificant. The disadvantage with these latter flame detectors is that their signal is highly dependent upon the operating conditions of the furnace.

SUMMARY OF THE INVENTION

An object of the invention is to provide a flame detector which is provided with a radiation sensor sensitive in the ultra-violet and/or visible range of the electro-magnetic spectrum and the output signal of which is largely insensitive to ignition sparks.

According to the present invention, there is provided a flame detector comprising:

a radiation sensor sensitive in the ultra-violet and/or visible range of the electromagnetic spectrum, to produce a signal $U^1$ representing the radiation from a flame a first circuit which derives from the signal $U_1$ a first signal $U_2$ which is proportional to the direct voltage portion of the signal $U_1$;

a second circuit which derives from the signal $U_1$ a second signal $U_3$ which is proportional to the alternating voltage portion of the signal $U_1$, and a subtracter which forms an output signal $U_A$ of flame detector such that $$U_A=U_2-U_3.$$

The ignition sparks induce an alternating signal in the radiation sensor, which superimposes the direct signal of the flame, to the extent that this is present. The behaviour over time of this alternating signal is relatively constant and stable in the long-term. The invention makes use of this in that it determines the alternating voltage portion of the signal of the radiation sensor, and derives a direct signal from it which is of the same value as the direct voltage portion which the ignition sparks generate in the signal of the radiation sensor. By subtracting this direct signal derived from the alternating voltage portion from the whole direct voltage portion of the signal of the radiation sensor, a signal is consequently produced which represents only the portion originating from the flame.

As the ignition spark generator is operated with mains voltage, the signal produced by the ignition sparks in the flame detector has a frequency spectrum with maxima at the mains frequency and multiples of the mains frequency. There are ignition spark generators of a first type which generate a signal in the flame detector with a distinct maximum at mains frequency, and ignition spark generators of a second type which generate a signal in the flame detector with a distinct maximum at double the mains frequency. According to a further concept of the invention, the alternating voltage portion of the signal of the radiation sensor is therefore derived by means of a filter, the characteristic of which has a transparency higher by a predetermined factor for double mains frequency than for mains frequency. The signal at the output of the filter then corresponds to the direct voltage portion generated by both ignition spark generators of the first type and ignition spark generators of the second type.

BRIEF DESCRIPTION OF THE DRAWINGS

The above and other objects, features and advantages of the invention will be apparent from the following detailed description of illustrative embodiments which is to be read in connection with the accompanying drawings, in which.

DESCRIPTION OF THE PREFERRED EMBODIMENTS

Figure 1:
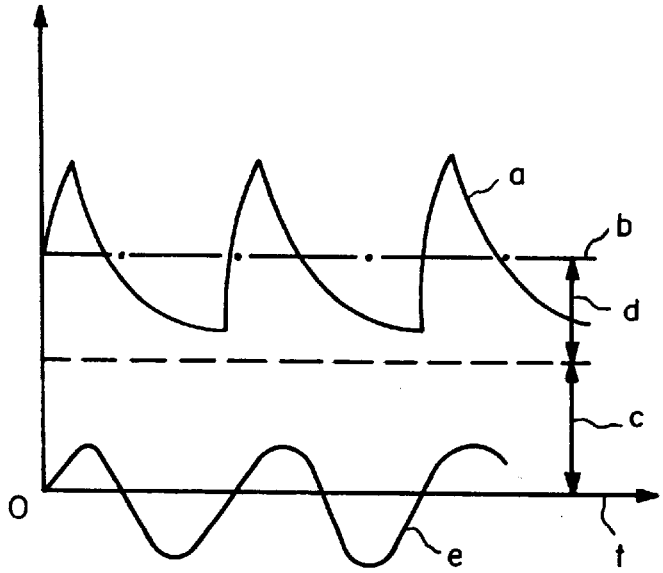
FIG. 1 is a waveform diagram showing the development over time of the signal of a radiation sensor and the separation thereof into different portions.

FIG. 1 shows as curve a the development over time of the signal $U_1$ of a radiation sensor 1 (FIG. 2) arranged in a furnace, when an ignition spark generator (of the first type) is in operation and producing ignition sparks, and when the flame is already burning. The direct voltage portion of the whole signal is shown as curve b, which contains a portion c coming from the flame and a portion d coming from the ignition sparks. Lastly, the portion of the alternating frequency coming from the ignition sparks is shown as curve e, the frequency of which corresponds to the mains frequency. The ratio of the amplitude of the alternating voltage portion (curve e) to the amplitude of the direct voltage portion (portion d) is different for ignition spark generators of different types. As is explained later, this variation can be compensated for by appropriate filters when the crucial frequencies of the alternating voltage portion are also different. This makes it possible to be able to use the same flame detector for different ignition spark generators.

Figure 2:
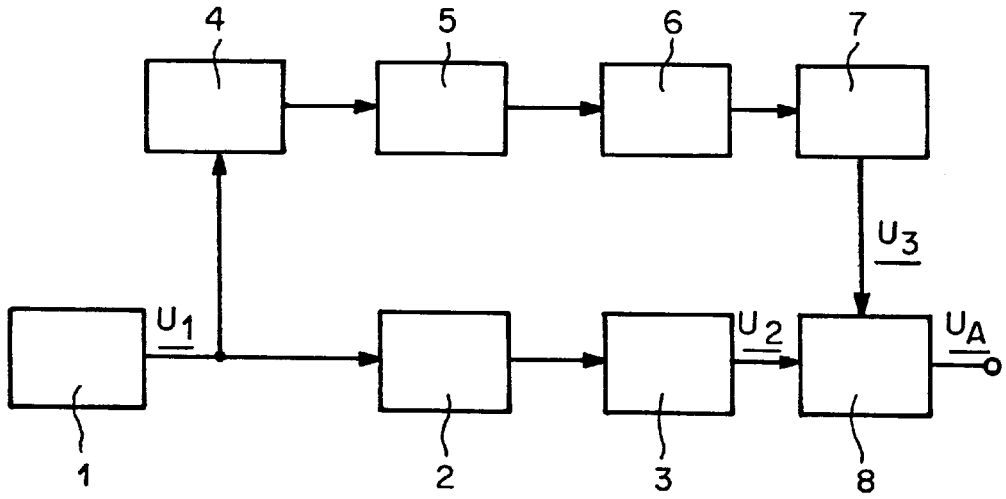
FIG. 2 is a block diagram of a flame detector in accordance with one embodiment of the invention.

FIG. 2 shows an example of a flame detector which is provided with a radiation sensor 1 sensitive in the ultra-violet and/or visible range of the electromagnetic spectrum as a sensor for detection of the radiation emitted by a flame of a furnace. The signal $U_1$, at the output of the radiation sensor 1 is now filtered on the one hand conventionally by means of a low pass filter 2 and amplified by means of a subsequent amplifier 3 to form a signal $U_2$. On the other hand, the signal $U_1$, is filtered by means of a high pass filter 4, amplified by means of a second amplifier 5, rectified by means of a rectifier 6, and smoothed by means of a second low pass filter 7. The signal $U_2$ is consequently proportional to the direct voltage portion of the signal $U_1$, at the output of the radiation sensor 1, while the signal $U_3$ at the output of the low pass filter 7 is proportional to the alternating voltage portion of the signal $U_1$. A subtracting means 8 forms from signals $U_2$ and $U_3$ the output signal $U_A$ of the flame detector $$U_A=U_2=U_3$$

The amplification factor of the second amplifier 5 compared to the amplification factor of the first amplifier 3 is to be adjusted according to the ratio of the alternating voltage portion (FIG. 1, curve e) to the direct voltage portion (FIG. 1, amplitude d) of the signal induced by the ignition sparks, and taking into account the characteristic of the filters 2, 4 and 7, such that the value of the direct output signal $U_A$ is independent of whether the ignition sparks make a contribution to the signal $U_1$ or not.

Figure 3:
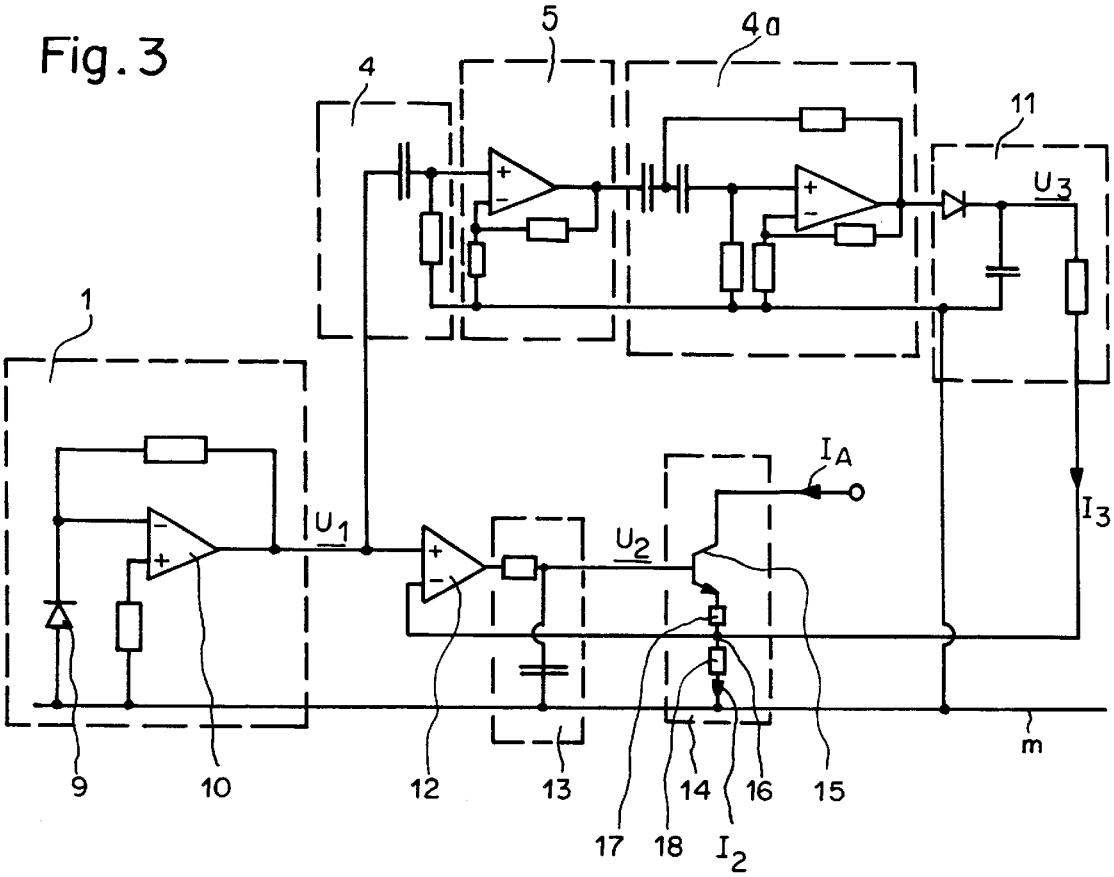
FIG. 3 is a circuit diagram of a flame detector in accordance with another embodiment of the invention.

FIG. 3 shows a circuit diagram of another example of a flame detector, wherein the symbols used for resistors, capacitors, diodes, operation amplifiers and transistors correspond to the symbols normally used in electronics. In this instance, the output signal of the flame detector is not the voltage $U_A$, but instead the current $I_A$ corresponding to the voltage $U_A$. The radiation sensor 1 is provided with a UV diode 9 sensitive in the ultra-violet range, and an amplifier 10 which directly amplifies the extremely weak signals of the UV diode 9. The reference potential is labelled m. The supply to the active components is not shown for reasons of clarity.

In Europe, mains frequency is nominally 50 Hz, in the USA 60 Hz. The figures given in the example are tailored to European arrangements. In order to obtain the alternating voltage portion $U_3$, the signal $U_1$, of the output of the radiation sensor 1 is fed to a high pass filter 4 formed by a capacitor and a resistor, is amplified by means of the second amplifier 5, filtered by means of a second high pass filter 4*a* which is, for example, a 2nd order Chebyshev filter, such that the 100 Hz components (double mains frequency) of the signal $U_1$. is amplified more strongly by a pre-determined factor than the 50 Hz components (mains frequency) of the signal $U_1$. and afterwards converted into a current $I_3$ by means of a voltage/current converter 11 acting simultaneously as a peak detector.

In order to obtain the direct voltage portion $U_2$ of the signal $U_1$, the signal $U_1$, is filtered and amplified in a circuitry module composed of an operation amplifier 12 switched as an impedance converter, an RC element 13, and a voltage/current converter 14. The transistor 15 of the voltage/current converter 14 is controlled by the operation amplifier 12 such that the voltage at the junction 16 between the two resistors 17, 18 is equal to the direct voltage portion $U_2$ of the voltage $U_1$, delivered from the radiation sensor 1 which is at the positive input of the operation amplifier 12. The junction 16 is now also supplied with the current $I_3$ so, as a result, the current $I_A$ flowing through the transistor 15 reduces by the current $I_3$. The voltage/current converter 14 consequently fulfils at the same time the function of a subtraction element 8 (FIG. 2). The output of the flame detector consequently carries the current $I_A-I_2-I_3$, wherein the current $I_2$ is a current proportional to the voltage $U_2$. The current $I_A$ flowing through the transistor 15 is thus proportional to the radiation emitted by the flame and measured with the UV diode 9.

Figure 4:
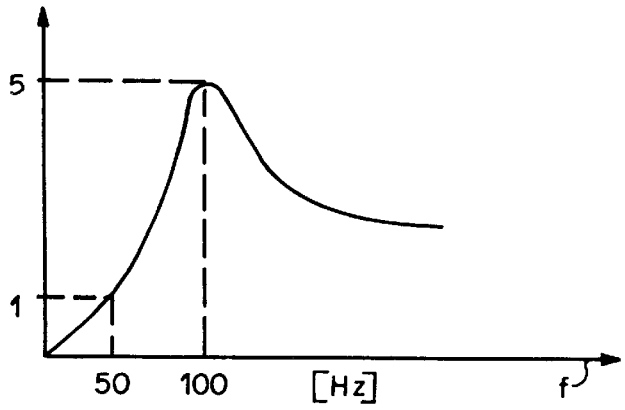
FIG. 4 is the characteristic of a filter of the detector of FIG. 3.

FIG. 4 shows the filter characteristic produced as a whole by the high pass filter 4, the amplifier 5 and the second high pass filter 4*a* according to the circuit design shown in FIG. 3. The high pass filter 4*a* which is preferably effected as a 2nd order Chebyshev filter is dimensioned such that the 100 Hz frequency (double mains frequency) has an amplitude approximately five times more than the 50 Hz frequency (mains frequency). This makes possible the use of the flame detector for ignition spark generators of both the first and the second type.

The flame detector also suppresses signals from other light sources such as, for example, neon tubes, which generate an alternating voltage portion at mains frequency or harmonics thereof in the signal of the radiation sensor 1 (FIG. 2). According to the amplitude of the alternating voltage portion, a differently sized portion is subtracted from the signal $U_3$. It has been shown that this portion is more than sufficient to fully compensate for the direct voltage portion induced by neon tubes.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. A flame detector comprising:

a radiation sensor sensitive in the ultra-violet and/or visible range of the electro-magnetic spectrum, to produce a signal $U_1$ representing the radiation from a flame a first circuit which derives from the signal $U_1$ by means of a first low pass filter a first signal $U_2$ which is proportional to the direct voltage portion of the signal $U_1$;

a second circuit which derives from the signal $U_1$ by means of a high pass filter followed by a second low pass filter a second signal $U_3$ which is proportional to the alternative voltage portion of the signal $U_1$, and a subtracter which forms an output signal $U_A$ of flame detector such that $$U_A=U_2-U_3.$$

2. A flame detector according to claim 1, wherein the signal $U_3$ derived from the alternating voltage portion of the signal $U_1$ is approximately the same size as the portion of the direct voltage signal generated by ignition sparks in the signal $U_1$.

3. A flame detector according to claim 1, wherein the second circuit comprises a high pass filter which has a transmittance for the double mains frequency greater by a pre-determined factor than for the mains frequency.

4. A flame detector according to claim 1, wherein signals $U_A$, $U_2$ and $U_3$ are voltages.

5. A flame detector according to claim 1 wherein signals $U_A$, $U_2$ and $U_3$ are currents.

* * * * *